US009743733B2

(12) United States Patent
Husbands

(10) Patent No.: US 9,743,733 B2
(45) Date of Patent: Aug. 29, 2017

(54) CARD IDENTITY CONCEALMENT DEVICE

(71) Applicant: Ronald Husbands, Brooklyn, NY (US)

(72) Inventor: Ronald Husbands, Brooklyn, NY (US)

( * ) Notice: Subject to any disclaimer, the term of this patent is extended or adjusted under 35 U.S.C. 154(b) by 0 days.

(21) Appl. No.: 14/522,632

(22) Filed: Oct. 24, 2014

(65) Prior Publication Data

US 2016/0113369 A1 Apr. 28, 2016

(51) Int. Cl.
*A45C 1/02* (2006.01)
*A45C 11/18* (2006.01)

(52) U.S. Cl.
CPC ..... *A45C 11/182* (2013.01)

(58) Field of Classification Search
CPC ..... A45C 2991/065; A45C 11/82; A45C 2001/065; A45C 11/182
USPC ..... 150/147; 206/37, 37.1, 37.5, 39.4
See application file for complete search history.

(56) References Cited

U.S. PATENT DOCUMENTS 5,506,395 A * 4/1996 Eppley ..... G06K 19/02 150/147
5,700,036 A * 12/1997 Smith, III ..... A45C 11/182 283/116
6,845,863 B1 * 1/2005 Riley ..... A45C 11/182 150/147
2009/0065111 A1 * 3/2009 Ohayon ..... G06Q 20/10 150/147
2011/0048594 A1 * 3/2011 Arnone ..... A45C 11/182 150/147
2015/0041340 A1 * 2/2015 Greenwalt ..... A45C 11/182 206/37

* cited by examiner

*Primary Examiner* — Sue A Weaver
(74) *Attorney, Agent, or Firm* — The Law Firm of Andrea Hence Evans, LLC

(57) ABSTRACT

A card identity concealment device partially covers a card to conceal an identity portion on the card, while still enabling functionality of the card by allowing access to a reading portion on the card. The device protects against unauthorized viewers, identity theft, or physical damage to the card and allows easy insertion into a Credit Card reader. A first panel overlays a substantial region of the first side, including the identity portion. The first panel includes a first panel indicia that creates a false identity for the card by indicating a different card information than on the identity portion of the card. Second panel is spaced parallel and joined along at least two opposing sides with the first panel. The second panel is adapted for receiving the card, while still allowing access to the reading portion.

12 Claims, 14 Drawing Sheets

CARD IDENTITY CONCEALMENT DEVICE

FIELD OF THE INVENTION

The present invention relates generally to a card identity concealment device. More so, a card identity concealment device partially covers a substantial portion of the first side of a card to conceal an identity portion on the card, while still enabling functional usage of the card by allowing access to a reading portion on a second side of the card.

BACKGROUND OF THE INVENTION

The following background information may present examples of specific aspects of the prior art (e.g., without limitation, approaches, facts, or common wisdom) that, while expected to be helpful to further educate the reader as to additional aspects of the prior art, is not to be construed as limiting the present invention, or any embodiments thereof, to anything stated or implied therein or inferred thereupon.

The following is an example of a specific aspect in the prior art that, while expected to be helpful to further educate the reader as to additional aspects of the prior art, is not to be construed as limiting the present invention, or any embodiments thereof, to anything stated or implied therein or inferred thereupon.

By way of educational background, another aspect of the prior art generally useful to be aware of is that a card can include a credit card, an identity card, and an EBT card. The most common type of card is a payment card issued to users as a system of payment. It allows the cardholder to pay for goods and services based on the holder's promise to pay for them. The issuer of the card creates a revolving account and grants a line of credit to the cardholder from which the cardholder can borrow money for payment to a merchant or as a cash advance to the cardholder.

Typically, the size of most cards is 3⅜×2⅛ in (85.60×53.98 mm). The cards have a printed or embossed bank card number, a cardholder name, and a card issuer logo on a front side. The back side often includes a magnetic strip that contains data pertinent to the monetary amount of the card, a signature line, and a security code. Often, identification card, credit cards, and EBT cards are designed to be used without having any means of concealing disguising the appearance of the card or its recognizable characteristics.

In many instances, welfare is the provision of a minimal level of well-being and social support for all citizens, sometimes referred to as public aid. Electronic Benefit Transfer (EBT) is an electronic system that allows state welfare departments to issue benefits through a magnetically encoded payment card, called an EBT card. Common benefits provided through the EBT card are typically of two general categories: food and cash benefits. Food benefits are federally authorized benefits that can be used only to purchase food and non-alcoholic beverages, often in public places. However, in many instances, an individual using a public assistance card in a public location cannot conceal the identity of the EBT card and is subject to public scrutiny.

It is well known that identity theft is a form of stealing someone's identity in which someone pretends to be someone else by assuming that person's identity, usually as a method to gain access to resources or obtain credit and other benefits in that person's name. The most common type is financial identity theft, where an identity thief wants to gain economic benefits by using a victim's name or other identity information. This includes getting credits, loans, goods and services, claiming to be someone else. Stealing bank or credit cards, identification cards, passports, authentication tokens is the most common form of identity theft. This can often be as simple as spying on a card user to view and memorize the information displayed on the card; or simply with the aid of a smart phone camera. Most cards do not have a barrier to cover the important information displayed on the card.

Even though the above cited methods for concealing information on a card address some of the needs of the market, a card identity concealment device for concealing portions of a first side of a card, and enabling access to portions of a second side of the card is still desired.

SUMMARY OF THE INVENTION

The present invention is directed to a card identity concealment device covers a substantial portion of a first side of a card to conceal an identity portion on the card, while still enabling functional usage of the card by allowing access to a reading portion on a second side of the card. The concealment device is adapted to easily receive the card, forming a protective surface from physical damage and unauthorized viewing. The concealment device also displays faux information to mislead unauthorized viewers about the card.

In some embodiments, the concealment device comprises a first panel that overlays a substantial region of a first side of the card, including the identity portion. The first panel may include a security function in the form of a first panel indicia, such as text, numbers, images, and logos that display from the first panel when the first panel overlays the card. The first panel indicia create a faux identity for the card by indicating a different card holder, card issuer, card identity number, or other information found in the identity portion. This creates the impression of a different card to mislead unauthorized viewers of the card.

The device further comprises second panel spaced parallel to the first panel and joined along at least two opposing sides with the first panel. The second panel second panel overlays at least a portion of the second side of the card. The second panel, along with the first panel, is adapted for receiving the card. The second panel is arranged to enable visual and functional access to the reading portion on the second side of the card. In one embodiment, at least one lengthwise centrally disposed space may form between two pockets to enable access to the reading portion. The space is sized and dimensioned to enable access to the reading portion, such as a magnetic strip, to a reading apparatus. The device is also effective for protecting the card from physical damage.

In some embodiments, the identity portion resides on the first side of the card. The identity portion provides a visual confirmation about the identity of the card holder and the issuing organization. The concealment device operates on the premise that it may be desirable to conceal the identity portion. The reading portion of the card is on a second side of the card, and can include a magnetic strip, a signature strip, and a card security code. The reading portion provides data that may be read by a reading device for operatively linking to the respective account of the card. This information is required for the operational functions on the card, and thus, the concealment device does not cover the reading portion.

One aspect of the present invention is a concealment device for concealing portions of a first side of a card, and enabling access to portions of a second side of the card, the concealment device comprising:

a first panel configured to overlay an identity portion of a card, the first panel comprising a first panel indicia; and a second panel spaced parallel to the first panel and joined along at least two opposing sides with the first panel, the second panel and the first panel adapted to receive the card, the second panel further configured to enable access to a reading portion on the card.

In another aspect, the device comprises a substantially rectangular, planar sheath adapted to receive the card.

In another aspect, the card comprises a credit card.

In another aspect, the card comprises a first side and a second side.

In another aspect, the identity portion displays from the first side.

In another aspect, the identity portion comprises a card holder name, a card issuer logo, and a card number.

In another aspect, the first panel comprises a first panel indicia.

In another aspect, the first panel indicia comprises a different card number and a different card issuer logo than displayed on the card.

In another aspect, the reading portion displays on the second side.

In another aspect, the reading portion comprises a magnetic strip.

In another aspect, the second panel comprises two pockets.

In another aspect, the two pockets from a lengthwise centrally disposed space between the pockets.

In another aspect, the magnetic strip is visible through the space.

In another aspect, the device comprises a composition of at least one of the following: a rigid polymer, a rigid polymer, and adhesive, and a laminated paperboard.

One objective of the present invention is to at least partially cover any type of card to give the card a different appearance.

Another objective is to substantially conceal a first side of the card having the card number, card holder name, and card issuer logo.

Another objective is to enable access to a second side of the card having the magnetic strip, the signature strip, and the security code.

Another objective is to create a faux identity for the card to mislead unauthorized viewers.

Another objective is to provide a second panel and a front panel that are adapted to enable easy reception and removal of the card from the concealment device.

Yet another objective is to protect the card from physical damage.

Yet another objective is to minimize the sense of shame associated with using a public assistance card, such as an EBT card.

Yet another objective is to provide an inexpensive and easy to manufacture concealment device for cards.

These and other advantages of the invention will be further understood and appreciated by those skilled in the art by reference to the following written specification, claims and appended drawings.

BRIEF DESCRIPTION OF THE DRAWINGS

The invention will now be described, by way of example, with reference to the accompanying drawings, in which:

FIG. 1A illustrates an exemplary first panel of the card concealment device displaying exemplary first panel indicia, FIG. 1B illustrates an explosive view of the pocket enclosure and the rectangular aspect of the identity concealment device, and FIG. 1C illustrates the first and second panels adhered together and configured to receive a card, in accordance with an embodiment of the present invention;

FIG. 2A illustrates the second side of the card, FIG. 2B illustrates the second panel receiving the card, and FIG. 2C illustrates the second panel enabling access to an exemplary reading portion in the second side of the card, in accordance with an embodiment of the present invention;

FIG. 3A illustrates a first panel overlaying the first side of the card, FIG. 3B illustrates a second panel having an exemplary second panel opening, and moving to cover the second side of the card, and FIG. 3C illustrates the second panel covering the second side of the card and leaving the reading portion exposed, in accordance with an embodiment of the present invention;

FIG. 5A illustrates the second panel forming a pair of pockets with a space therebetween, and FIG. 5B illustrates the second panel of the card concealment device covering the card, in accordance with an embodiment of the present invention;

FIG. 7A illustrates a top view, and FIG. 7B illustrates an elevated side view, in accordance with an embodiment of the present invention;

FIG. 8A illustrates a top view, and FIG. 8B illustrates an elevated side view, in accordance with an embodiment of the present invention;

Like reference numerals refer to like parts throughout the various views of the drawings.

DETAILED DESCRIPTION OF THE INVENTION

Figure 1A:
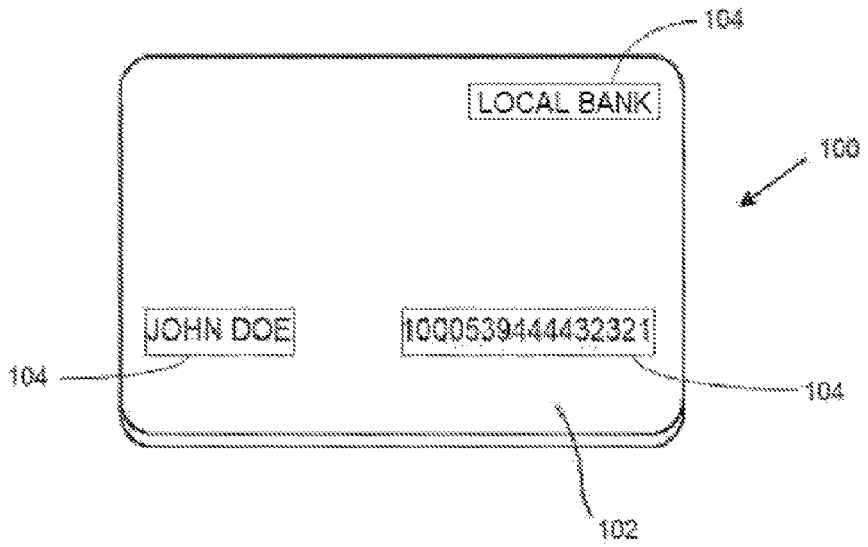
FIGS. 1A, 1B, and 1C illustrate top views of an exemplary identity concealment device, where

The following detailed description is merely exemplary in nature and is not intended to limit the described embodiments or the application and uses of the described embodiments. As used herein, the word "exemplary" or "illustrative" means "serving as an example, instance, or illustration." Any implementation described herein as "exemplary" or "illustrative" is not necessarily to be construed as preferred or advantageous over other implementations. All of the implementations described below are exemplary implementations provided to enable persons skilled in the art to make or use the embodiments of the disclosure and are not intended to limit the scope of the disclosure, which is defined by the claims. For purposes of description herein, the terms "upper," "lower," "left," "rear," "right," "front," "vertical," "horizontal," and derivatives thereof shall relate to the invention as oriented in FIG. 1. Furthermore, there is no intention to be bound by any expressed or implied theory presented in the preceding technical field, background, brief summary or the following detailed description. It is also to be understood that the specific devices and processes illustrated in the attached drawings, and described in the following specification, are simply exemplary embodiments of the inventive concepts defined in the appended claims. Hence, specific dimensions and other physical characteristics relating to the embodiments disclosed herein are not to be considered as limiting, unless the claims expressly state otherwise.

At the outset, it should be clearly understood that like reference numerals are intended to identify the same structural elements, portions, or surfaces consistently throughout the several drawing figures, as may be further described or explained by the entire written specification of which this detailed description is an integral part. The drawings are intended to be read together with the specification and are to be construed as a portion of the entire "written description" of this invention as required by 35 U.S.C. §112.

In one embodiment of the present invention, presented in FIGS. 1A-10, a card identity concealment device 100 is configured to conceal the identity of a card 200, while still enabling functionality of the card 200. The concealment device 100 partially covers the card 200 to conceal an identity portion 204 on the card 200, while still enabling functional usage of the card 200 by allowing access to a reading portion 208 on the card 200. The concealment device 100 is adapted to easily receive the card 200, in such a manner that a protective surface is formed to protect from physical damage and unauthorized viewing.

In some embodiments, the concealment device 100 may also serve to display faux indicia over original card information to provide misleading information about the card 200 for security purposes. In one exemplary use, the concealment device 100 conceals and replaces text and digits on a first side 202 of the card 200, and leaves exposed a magnetic strip on a second side 206 of the card 200 to enable a reading apparatus 210, such as a credit card reader, to scan data on the magnetic strip. In essence, the concealment device 100 protects against unauthorized viewers, identity theft, or physical damage, while still allowing the card 200 to fit into Credit Card reader, without problem.

In some embodiments, the concealment device 100 may form a flat, rectangular protective sheath made from a semi-rigid plastic material to accommodate the card 200. The concealment device 100 is sufficiently flexible to form a malleable cover over the card 200. The card 200 may include, without limitation, a credit card, a charge card, an EBT card, and an identity card. In one operational use, the card 200 may be used to charge a payment for a product or service by operatively linking to a remote account. In one embodiment, the card 200 is sized and dimensioned at 3⅜"×2⅛", and the concealment device 100 is sized to receive the card 200 and form a snug fit. Though in other embodiments, the concealment device 100 can be configured to fit any sized or dimensioned card 200. Suitable materials for the concealment device 100 may include, without limitation, a flexible polymer, a rigid polymer, and adhesive and a laminated paperboard.

The concealment device 100 operates on the premise that it may be desirable to conceal the identity portion 204 of the card 200. As shown in FIG. 1A, the first panel indicia 104 displays on the first panel 102 of the device 100. The first panel 102 serves to cover an identity portion 204 that displays on a first side 202 of the card 200. The identity portion 204 provides a visual confirmation about the identity of a card holder and a card issuer. The identity portion 204 may include, without limitation, a name of a card holder, a card number, a bank logo, a card issuing agency, a hologram, an expiration date, and an EMV chip. Those skilled in the art will recognize that the identity portion 204 may be printed or embossed and also comply with ISO/IEC 7812 numbering standards.

Figure 1B:
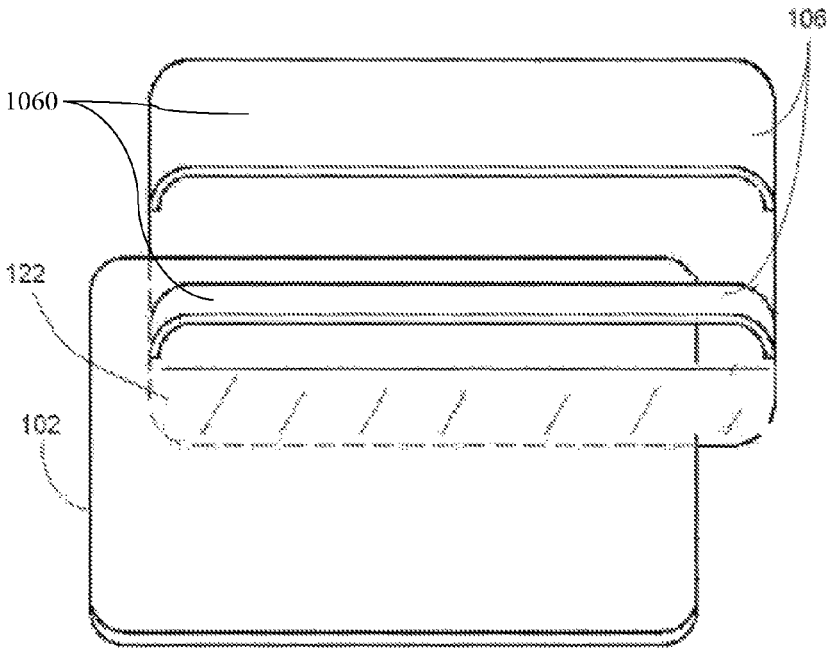

FIG. 1B shows second panel 1060 that is spaced parallel to the first panel 102 and jointed along at least two opposing sides with the first panel 102. The adhesive film 122 is solely for securing a user's card 200 more snugly within the second panel 1060. In any case, the second panel 1060 rests on the substantially rectangular foundation of the first panel 102. In some embodiments, the second panel 1060 may be adapted for receiving the card 200. The second panel 1060 overlays at least a portion of the second side 206 of the card 200.

Figure 1C:
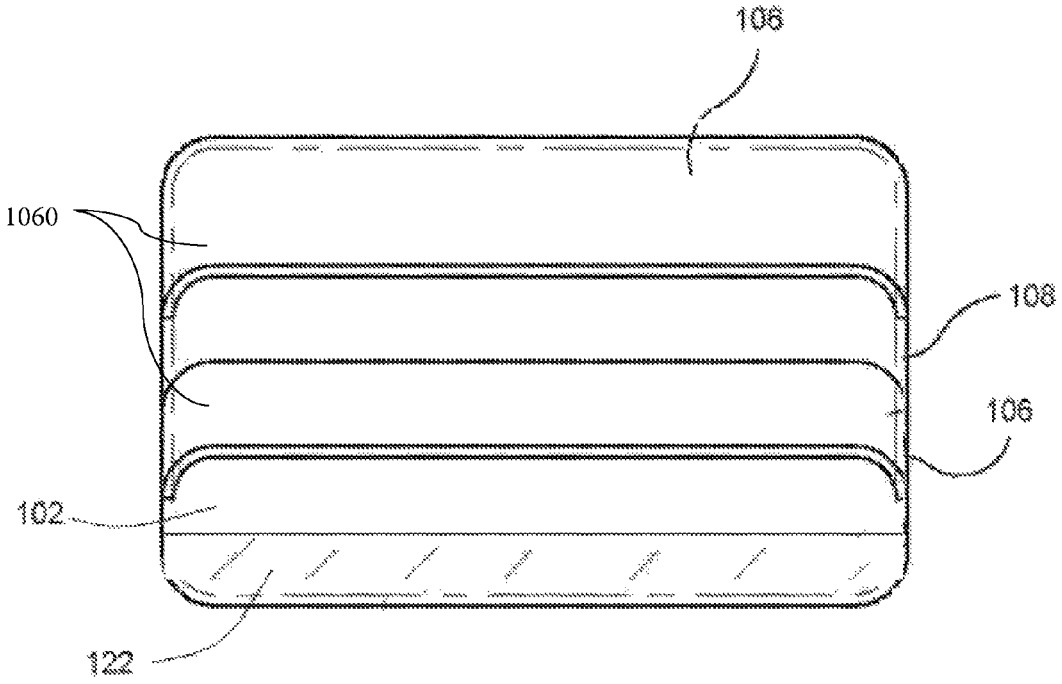

In one embodiment, referenced in FIG. 1C, the second panel 1060 comprises one, two, or more pockets spaced parallel to each other for receiving the card 200. The pockets are arranged to enable visual and functional access to the reading portion 208 on the second side 206 of the card 200. A space 108 forms between the pockets 106. The space 108 enables viewing and access to the reading portion 208 of the second side 206. The second panel 1060 may have a slightly curved lower edge that facilitates reception of the card 200 and helps the concealment device 100 slide into a standard card storage area of a wallet or purse.

Figure 2A:
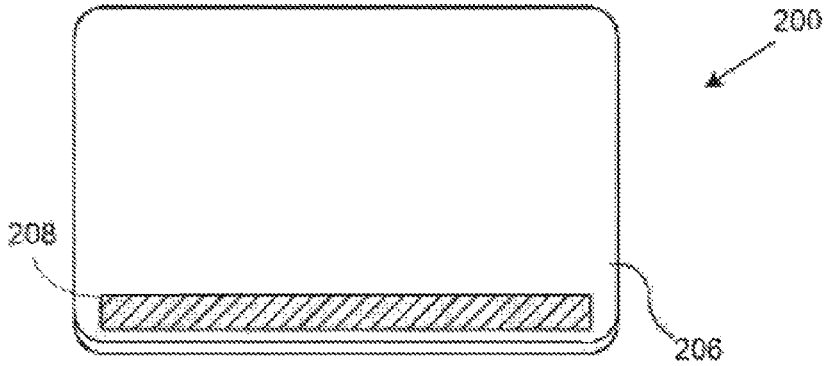
FIGS. 2A, 2B and 2C illustrate top views of the identity concealment device overlaying an exemplary second side of the card, where
Figure 2B:
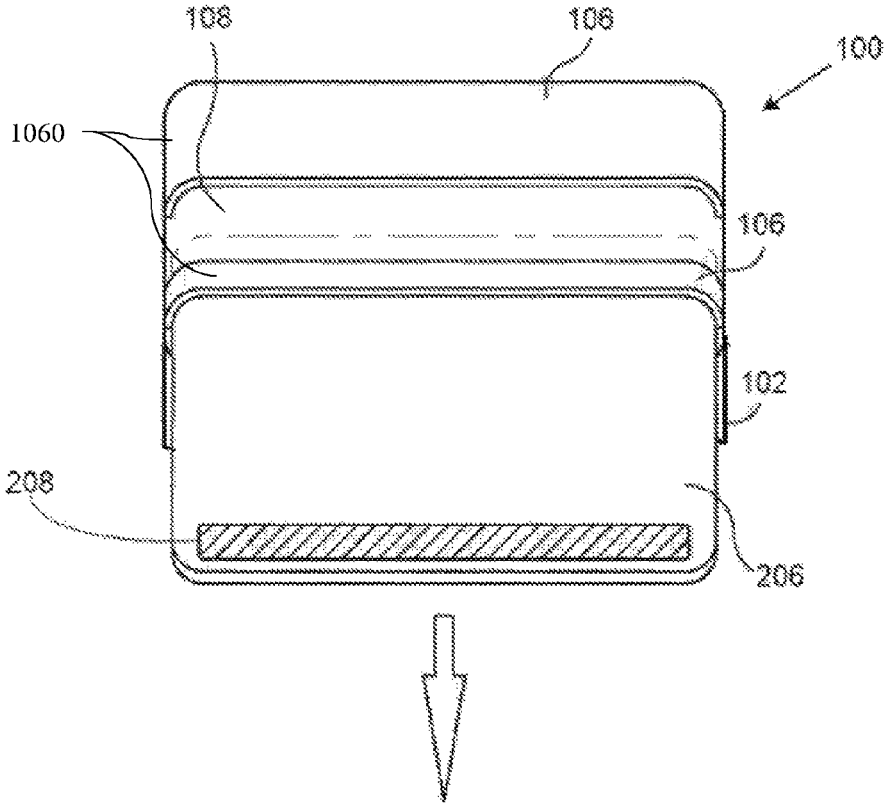
Figure 2C:
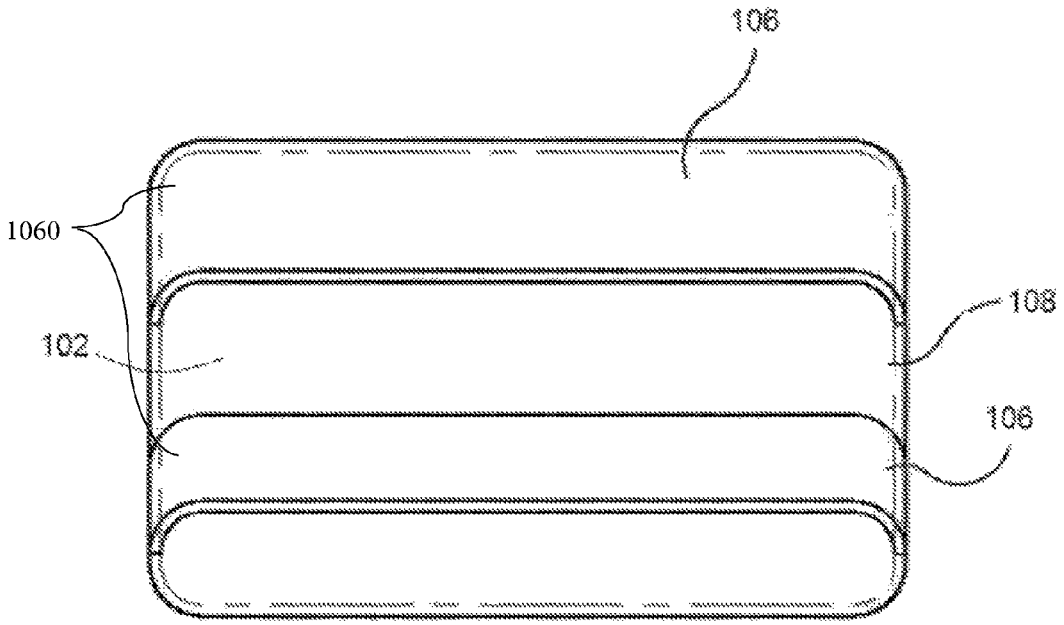

Turning now to FIG. 2A, a reading portion 208 resides on a second side 206 of the card 200, and can include a magnetic strip, a signature strip, and a card security code. The reading portion 208 provides data that may be read by a reading apparatus 210 for operatively linking to the respective account of the card 200. The reading portion 208 further comprises additional information that verifies that the card holder is indeed, the authorized user of the card 200. This information is required for the operational functions on the card 200; and thus, the concealment device 100 does not cover the reading portion 208. FIG. 2B illustrates the second panel 1060 receiving the card, and FIG. 2C illustrates the second panel 1060 enabling access to the reading portion 208 in the second side 206 of the card.

Figure 3A:
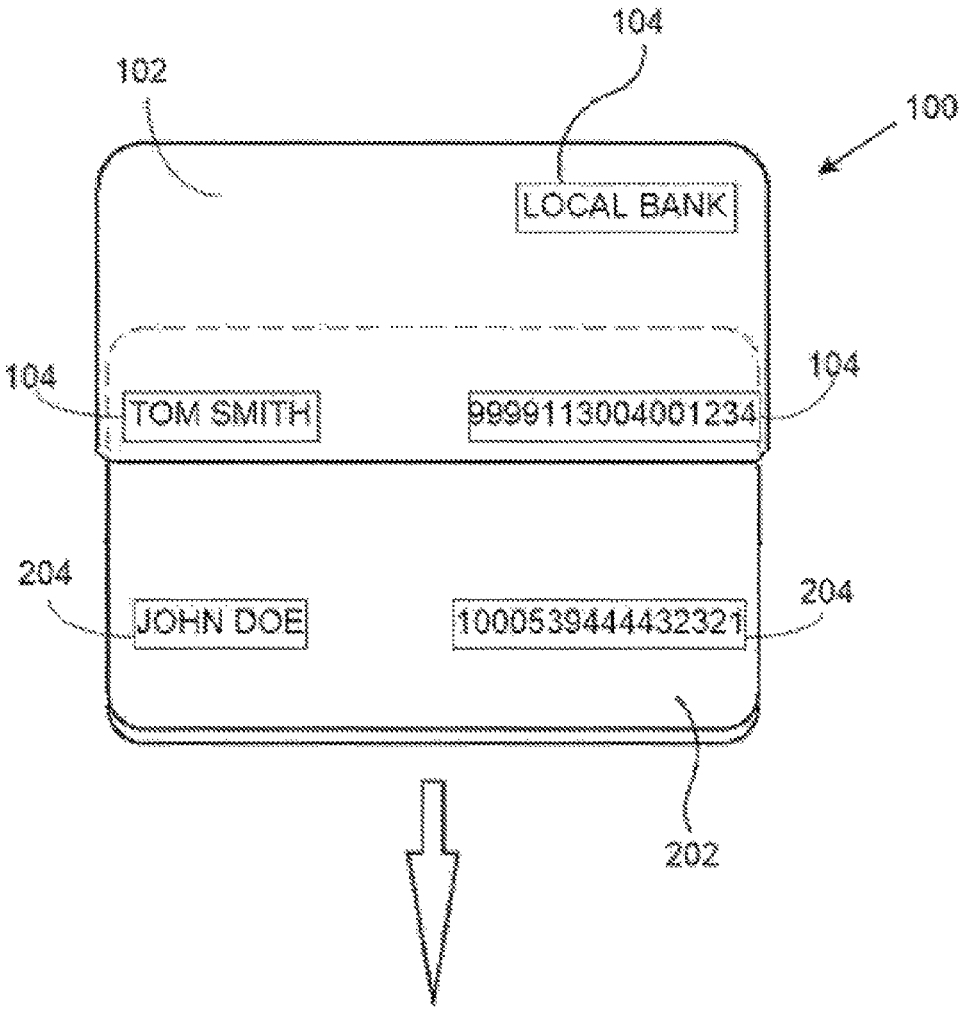
FIGS. 3A, 3B, and 3C illustrate an exemplary front side and an exemplary second side of the card engaging the card concealment device, where

FIG. 3A illustrates the first panel 102 overlaying a first side 202 of the card 200. The first panel 102 overlays a substantial section of the first side 202, including the identity portion 204. The first panel 102 provides a security function by displaying faux information about the card 200. The security function includes a first panel indicia 104 that depicts the faux information, often different than the identity portion 204 originally found on the card 200. The first panel indicia 104 may include, without limitation, text, numbers, images, and logos that display from the first panel 102 when the first panel 102 overlays the card 200. The first panel indicia 104 create a false identity for the card 200 by indicating a different card holder, card issuer, or card identity number than that found on the identity portion 204 of the card 200. The first panel indicia 104 creates the impression of a different card 200 to mislead unauthorized viewers about the true nature of the card 200.

In one exemplary use of the faux information formed by the first panel indicia 104, the concealment device 100 is used with a public assistance card, such as an EBT card. The identity portion 204 of the EBT card, which identifies the public assistance card as such, is substantially covered by the first panel 102. The first panel indicia 104 may then deceptively display a bank logo or other card issuer faux information to indicate that the EBT card is a standard credit card. This protects the card holder from the embarrassment of using an EBT card in public, and also provides security against identity theft.

Figure 3B:
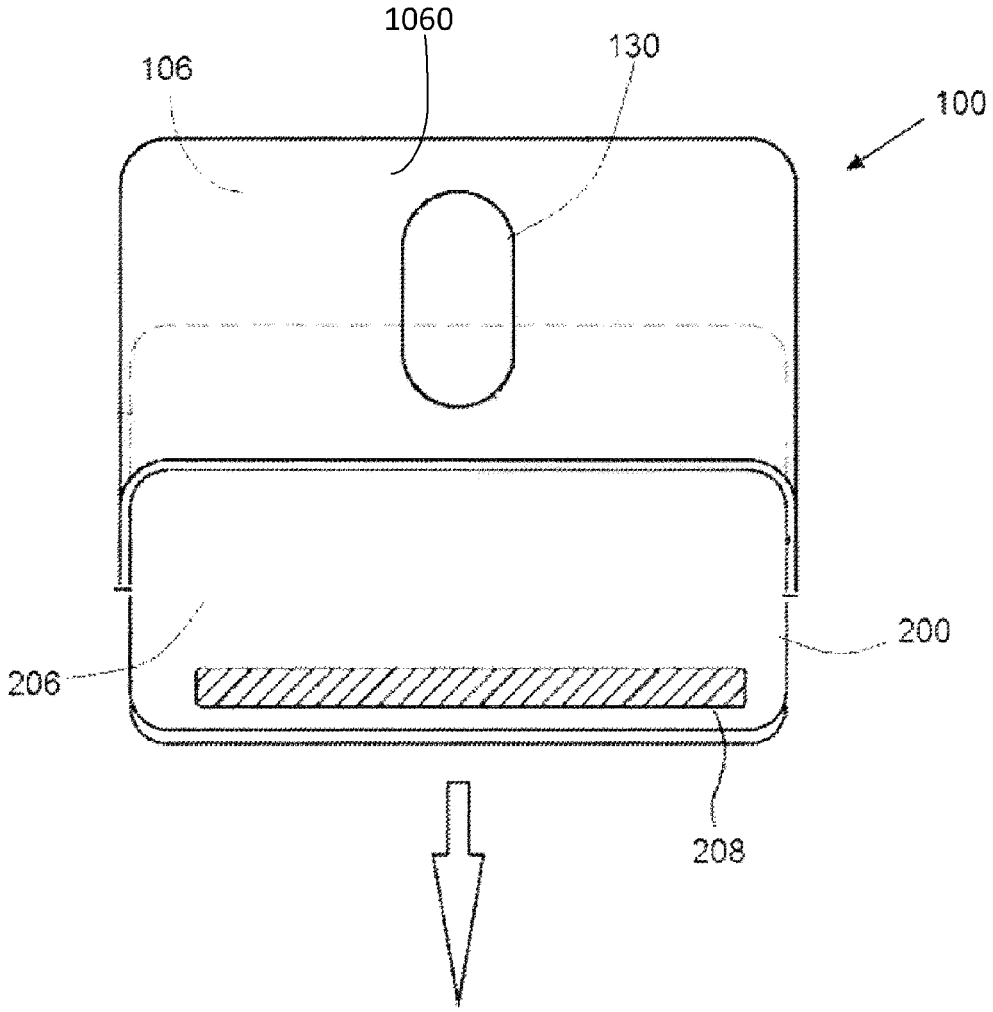
Figure 3C:
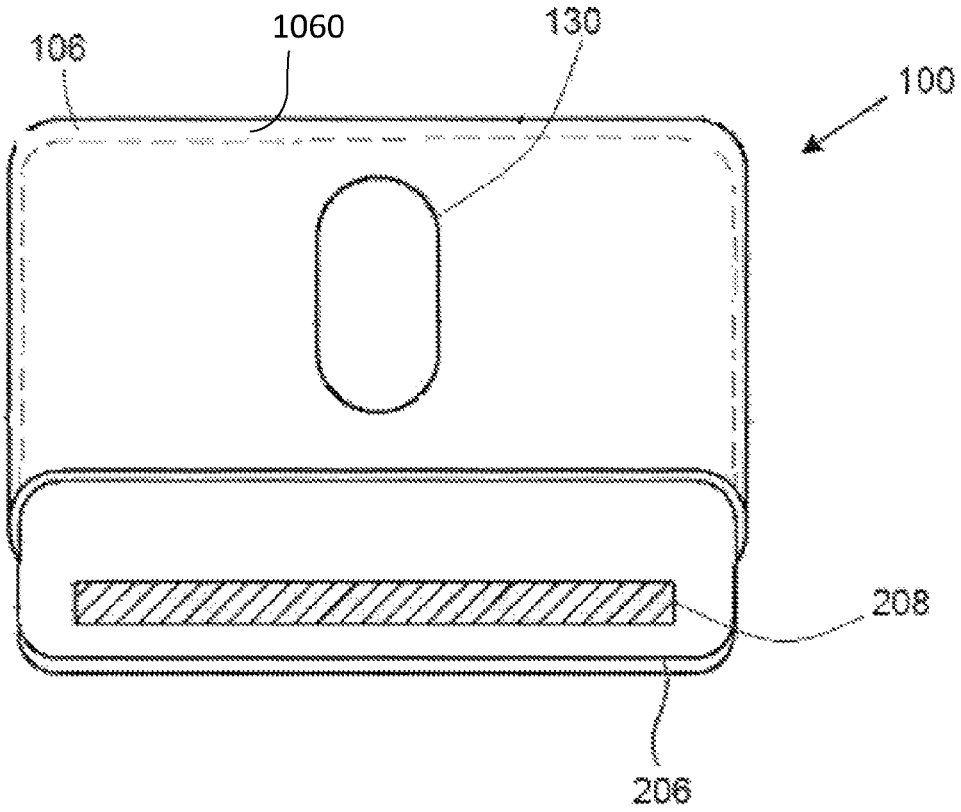

FIG. 3B illustrates the second panel 1060 with an exemplary second panel opening moving to cover the second side 206 of the card 200. The second panel opening provides a depression for the fingers or thumb to slide the device 100 over the card 200. In one embodiment, the second panel opening is a generally oval opening sized to receive a thumb. FIG. 3C illustrates the second panel 1060 overlaying the second side 206 of the card 200 and leaving the reading portion 208 exposed.

Figure 4:
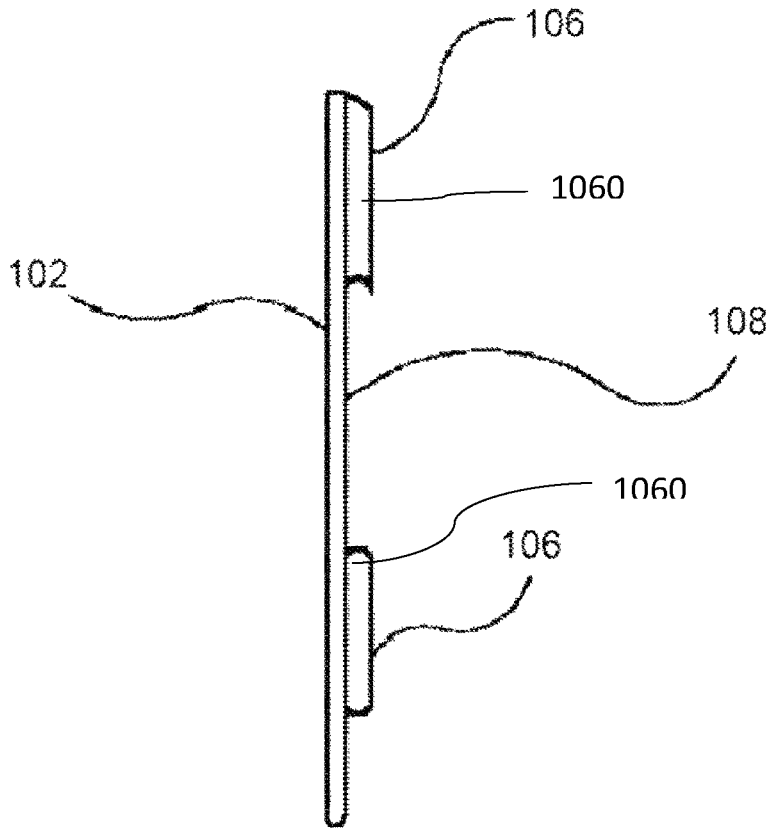
FIG. 4 illustrates an elevated side view of the identity concealment device, in accordance with an embodiment of the present invention.

As referenced in FIG. 4, the device 100 forms a thin dimension that is useful for receiving and substantially covering the card 200. This relatively slim dimensioning enables the card 200 to be stored in a wallet or purse storage area that is configured for most standard credit, debit, and EBT cards. It is also significant to note that the device 100 may be used interchangeably with variously sized and dimensioned cards 200. In one embodiment, the device 100 is fabricated from a rubber composition configured to stretch the second panel 1060 while receiving the card 200. This provides the advantage of allowing interchangeability between the concealment device 100 and the cards 200 for reducing cost of operation and adding an additional layer of security to confuse identity theft attempts.

Figure 5A:
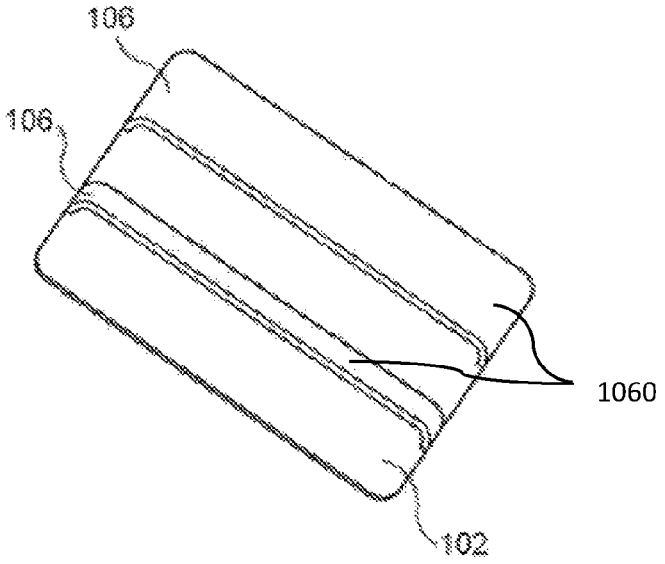
FIGS. 5A, and 5B illustrate perspective views of the card concealment device, where

FIG. 5A references the edges of the first panel 102 and the second panel 1060. The edges of the first panel 102 and the second panel 1060 may be connected at the periphery and entire surface area. The second panel 1060 sits on the rectangular shape of the first panel 102. In any case, the concealment device 100 forms a snug fit around the card 200, which is effective for protecting the card 200 from physical damage, and allows the card 200 to fit into a Credit Card reader without problem.

Figure 5B:
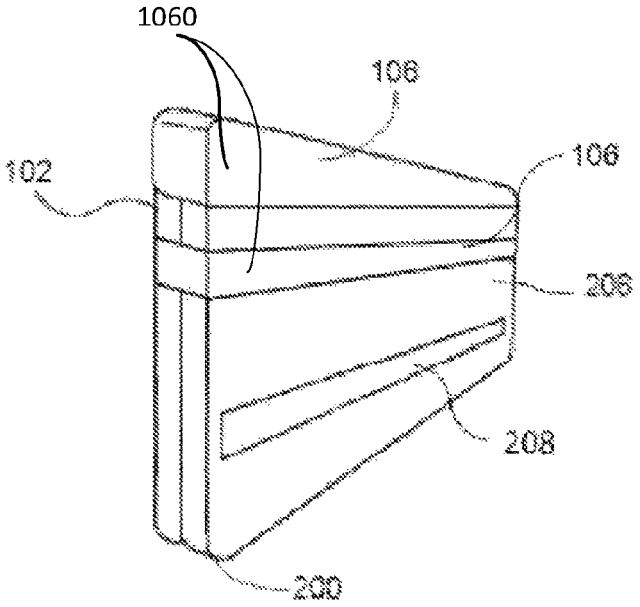
Figure 6:
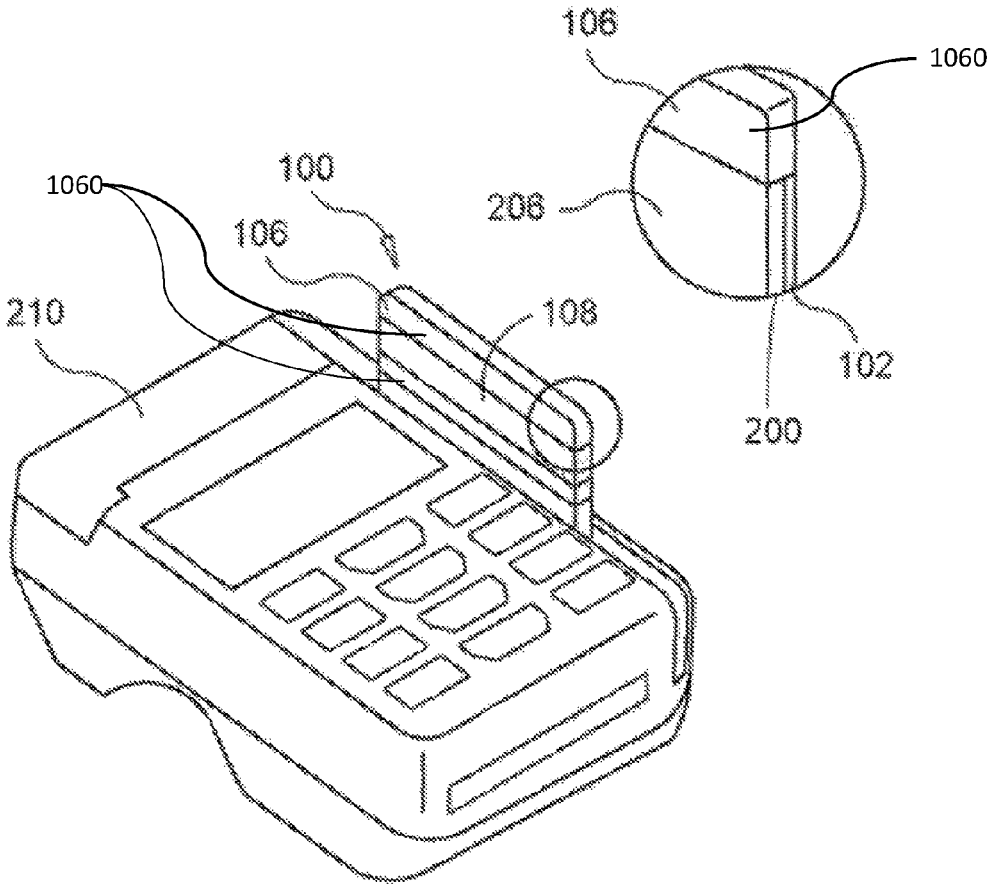
FIG. 6 illustrates a detailed perspective view of an exemplary reading apparatus scanning a reading portion of the card, in accordance with an embodiment of the present invention.

As referenced in FIG. 5B, the second panel 1060 is arranged to enable visual and functional access to the reading portion 208 on the second side 206 of the card 200. In one embodiment, at least one lengthwise centrally disposed space 108 may form on the second panel 1060 to expose the reading portion 208, such as a magnetic strip, to a reading apparatus 210 (FIG. 6). The space 108 facilitates use of the magnetic strip. The reading apparatus 210 may include, without limitation, a credit card reading machine, a scanner, and a smart phone having an app for reading bar codes and magnetic strips. In this manner, the concealment device 100 enables the true identity of the card 200 to be covered and replaced, while the functionality of the card 200 is maintained.

Figure 7A:
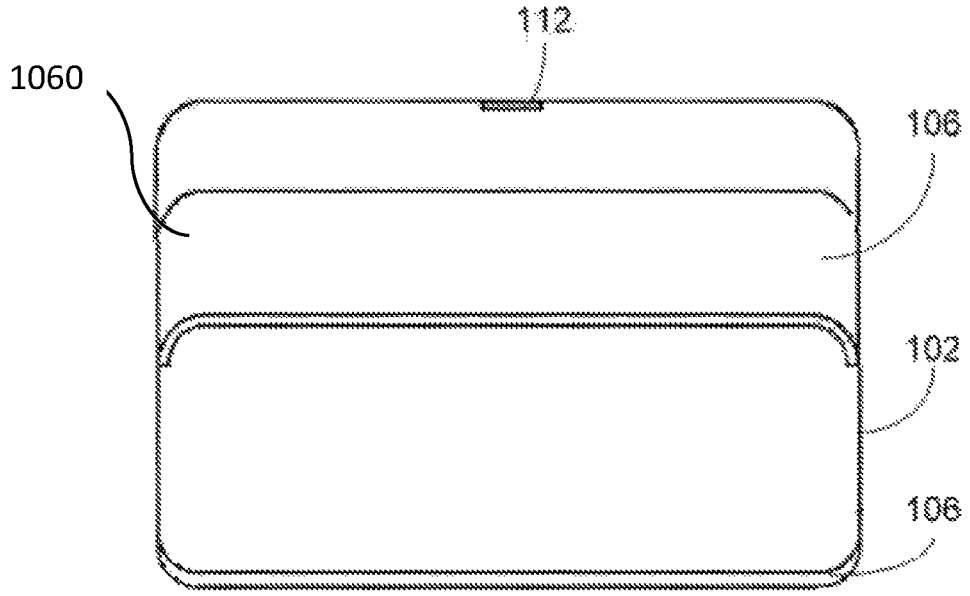
FIGS. 7A and 7B illustrate various views of the identity concealment device having an elevated member for restricting movement of the card, where
Figure 7B:
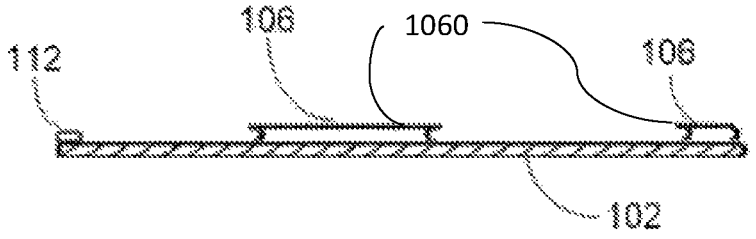

FIGS. 7A and 7B illustrate the identity concealment device 100 having an elevated member 112 for restricting movement of the card 200. In the present invention, the device 100 may help restrict movement of the card 200 through at least one elevated member 112 positioned on the periphery of the device 100. The at least one elevated member 112 acts as a physical barrier to restrain the card 200 within the periphery of the device 100. In this manner, a card 200 that has been positioned within the device 100 is at least partially restricted from sliding out.

Figure 8A:
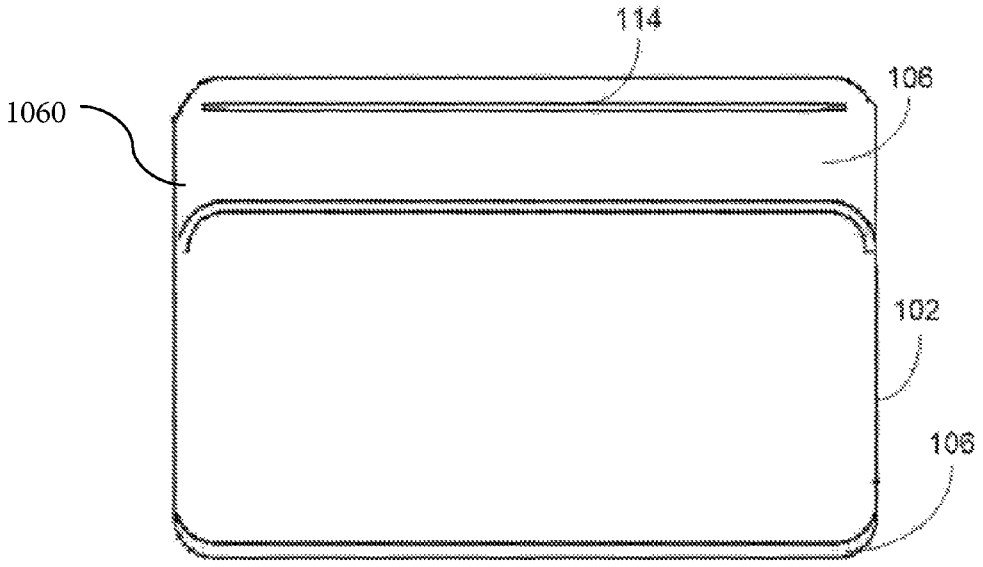
FIGS. 8A and 8B illustrate various views of the identity concealment device having a slot for enabling entry of the card into the identity concealment device, where
Figure 8B:
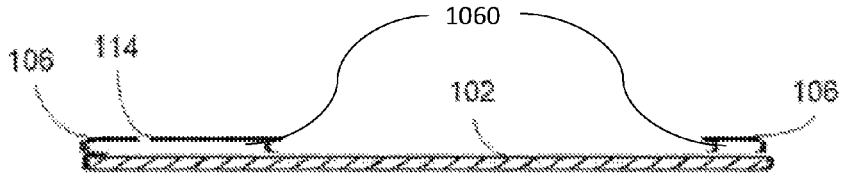

FIGS. 8A and 8B illustrate the identity concealment device 100 having a slot 114 for enabling entry of the card 200 into the identity concealment device 100. In the present invention, the device 100 may include a slot 114 for enabling passage of the card 200 into position within the device 100. The slot 114 is sized and dimensioned to receive the card 200 for entry. The slot 114, however, is angled, such that the card 200 cannot easily slide back out through the slot 114, but only slide into the device 100. The slot 114 may be positioned in the second panel 1060, near a top end of the device 100.

Figure 9:
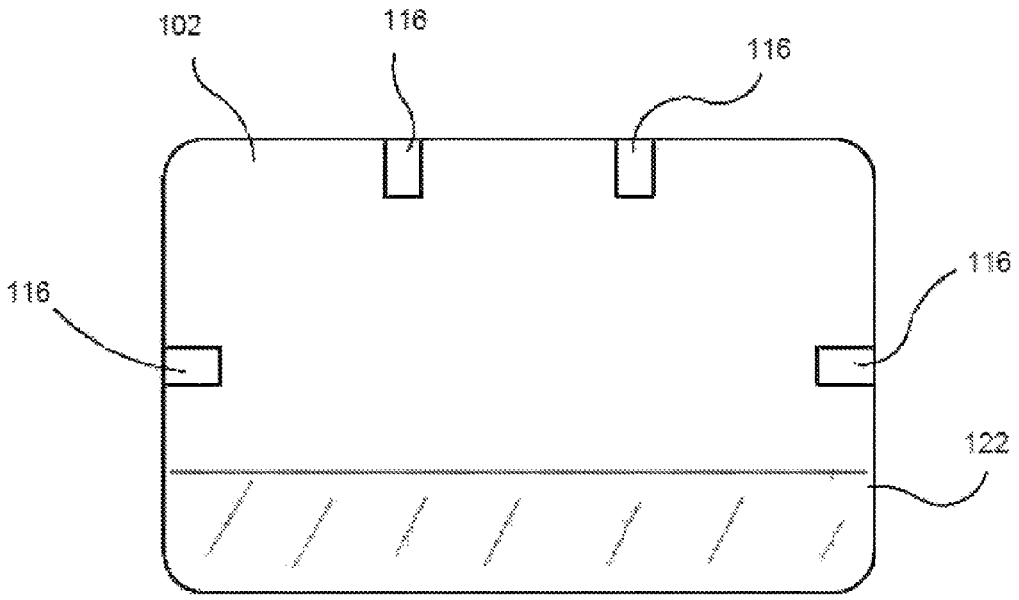
FIG. 9 illustrate a front view of the identity concealment device having an adhesive film and at least one locking mechanism for fastening of the card, in accordance with an embodiment of the present invention.

FIG. 9 illustrates the identity concealment device 100 having an adhesive film 122, and at least one locking mechanism 116 for fastening of the card 200. In yet another fastening means, the device 100 may include an adhesive film 122 that overlays the card 200 to secure the card 200 to the device 100. The adhesive film 122 may be transparent or colored depending on the embodiment. Additionally, the device 100 may include at least one locking mechanism 116 to further secure the card 200 to the device. The locking mechanism 116 may include, without limitation, a clip, a snug cavity, a spike, and a frictional snap. Each locking mechanism 116 can be positioned on an edge of the card 200. The locking mechanism 116 can be easily manipulated with one movement to receive or release the card 200.

Figure 10:
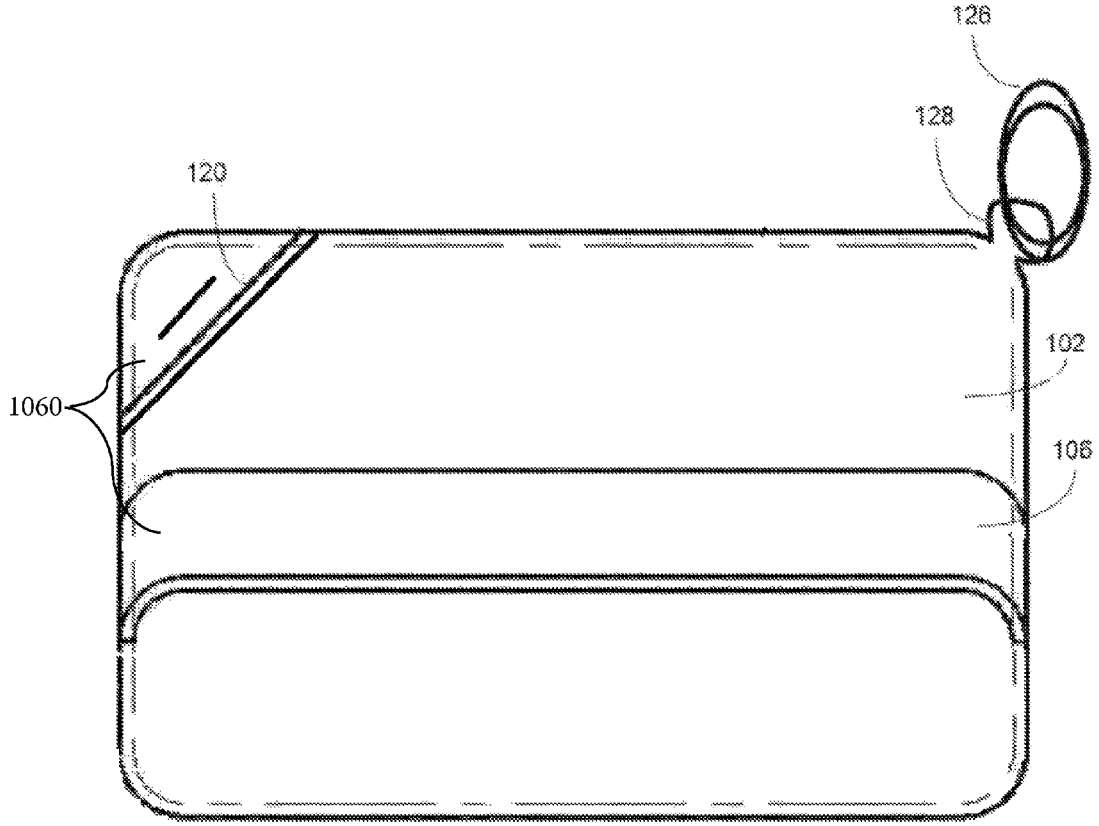
FIG. 10 illustrates a rear view of the identity concealment device having a corner pocket for partially receiving the card, in accordance with an embodiment of the present invention.

FIG. 10 illustrates a top view of the identity concealment device 100 having a corner pocket 120 for partially receiving the card 200. In the present invention, the device 100 may include a corner pocket 120 that works in conjunction with the second panel 1060 to receive and hold the card 200. While the pocket 106 may run lengthwise across the device 100, the corner pocket 120 retains the card 200 in a corner of the device 100. In one alternative embodiment, the device 100 may include various fasteners for attaching commonly used items to the device 100. For example, a detachable ring 126 serves to connect a keychain on the device 100. The ring 126 passes through a keychain hole 128 in the device 100. The keychain hole 128 can be positioned on a corner of the device 100, such that the ring 126 hangs loosely and does not contact the card 200. The ring 126 is external to the device 100 so that it does not engage the card 200. In one embodiment, the ring 126 can secure a set of keys, a USB flash drive, or any variety of small tools, to the device 100.

Since many modifications, variations, and changes in detail can be made to the described preferred embodiments of the invention, it is intended that all matters in the foregoing description and shown in the accompanying drawings be interpreted as illustrative and not in a limiting sense. Thus, the scope of the invention should be determined by the appended claims and their legal equivalence.

What I claim is:

1. A concealment device for concealing the identity of a card while still enabling functionality of the card, the concealment device comprising:

a first panel arranged to overlay a first side of a card, the first panel adapted to conceal an identity portion of the card, the first panel comprising a first panel indicia adapted to replace the identity portion; and a second panel adapted to receive the card, the second panel spaced parallel to the first panel and joined along at least two opposing sides with the first panel, the second panel configured to receive the card, the second panel further configured to enable access to a reading portion on the card;

wherein the first panel indicia comprises a different card number and a different card issuer logo or image than displayed on the card.

2. The device of claim 1, wherein the device comprises a substantially rectangular, planar sheath adapted to receive the card.

3. The device of claim 2, wherein the card comprises a credit card.

4. The device of claim 3, wherein the card comprises a first side and a second side.

5. The device of claim 4, wherein the identity portion displays from the first side.

6. The device of claim 5, wherein the identity portion comprises a card holder name, a card issuer logo, and a card number.

7. The device of claim 1, wherein the reading portion displays on a second side.

8. The device of claim 7, wherein the reading portion comprises a magnetic strip.

9. The device of claim 8, wherein the magnetic strip is visible through the space.

10. The device of claim 9, wherein the device comprises at least one locking mechanism configured to clamp the card to the device.

11. The device of claim 10, wherein the device comprises a second panel opening disposed to position on the second panel for facilitating manipulation of the device.

12. The device of claim 11, wherein the device comprises a composition from at least one of the following: a rigid polymer, an adhesive, and a laminated paperboard.

* * * * *